US009168571B2

(12) United States Patent
Desrosiers et al.

(10) Patent No.: US 9,168,571 B2
(45) Date of Patent: Oct. 27, 2015

(54) APPARATUS AND METHOD FOR CONTROLLED ACCESS TO PRESSURIZED FLUID LINES AND TO EXHAUSTED LINES

(71) Applicant: International Business Machines Corporation, Armonk, NY (US)

(72) Inventors: Robert Desrosiers, Essex Junction, VT (US); Mousa H. Ishaq, Essex Junction, VT (US); Robert L. Jourdain, Essex Junction, VT (US); Michael Lunn, Milton, VT (US); Donald A. Martin, Underhill, VT (US)

(73) Assignee: GLOBALFOUNDRIES INC., Grand Cayman (KY)

( * ) Notice: Subject to any disclaimer, the term of this patent is extended or adjusted under 35 U.S.C. 154(b) by 141 days.

(21) Appl. No.: 13/788,450

(22) Filed: Mar. 7, 2013

(65) Prior Publication Data

US 2014/0251443 A1 Sep. 11, 2014

(51) Int. Cl.

| | |
|---|---|
| ***B08B 9/027*** | (2006.01) |
| ***B08B 9/00*** | (2006.01) |
| ***B08B 9/04*** | (2006.01) |
| ***B08B 9/043*** | (2006.01) |
| ***B08B 9/032*** | (2006.01) |

(52) U.S. Cl.

CPC . *B08B 9/00* (2013.01); *B08B 9/027* (2013.01); *B08B 9/0328* (2013.01); *B08B 9/04* (2013.01); *B08B 9/043* (2013.01); *Y10T 137/0318* (2015.04); *Y10T 137/0402* (2015.04); *Y10T 137/4238* (2015.04); *Y10T 137/8593* (2015.04)

(58) Field of Classification Search

CPC ..... B08B 9/00; B08B 9/027; B08B 9/04; B08B 9/043; B08B 9/0436

USPC ..... 137/15.07, 15.01, 237, 240, 242, 244, 137/561 R

See application file for complete search history.

(56) References Cited

U.S. PATENT DOCUMENTS

| | | | | |
|---|---|---|---|---|
| 1,159,977 | A * | 11/1915 | Massey et al. | 137/242 |
| 4,551,041 | A | 11/1985 | Coon et al. | |
| 4,554,942 | A * | 11/1985 | Williams et al. | 137/240 |
| 4,938,246 | A * | 7/1990 | Conley et al. | 137/244 |
| 5,035,796 | A * | 7/1991 | Saylor et al. | 210/198.1 |
| 5,416,947 | A | 5/1995 | Jaffe | |
| 6,164,145 | A | 12/2000 | Jaeger | |
| 6,418,960 | B1 | 7/2002 | Mintz et al. | |
| 6,681,790 | B2 | 1/2004 | Knobbe et al. | |
| 6,841,007 | B1 | 1/2005 | Howard et al. | |
| 6,945,268 | B2 | 9/2005 | Law et al. | |
| 2008/0202594 | A1 | 8/2008 | Krywitsky | |
| 2013/0092249 | A1 * | 4/2013 | Al-Shammari | 137/237 |

* cited by examiner

*Primary Examiner* — Kevin Lee
(74) *Attorney, Agent, or Firm* — Schmeiser, Olsen & Watts

(57) ABSTRACT

A method and apparatus for controlled access to pressurized fluid lines and to exhausted lines. The apparatus includes a rod body having a bore; a packing fitting attached to a first end of the rod body and a ball valve attached to a second end of the rod body; a transverse arm between the first and second ends of the rod body, the transverse arm having a bore communicating the rod body bore; and a slideable rod in the bore of the rod body, in a first position of the rod a first end extends through the packing fitting to outside of the rod body and a second end is completely within the rod body, in a second position of the rod the first end extends through the packing fitting to outside of the rod body and the second end of the rod extends through and past the ball valve.

13 Claims, 6 Drawing Sheets

APPARATUS AND METHOD FOR CONTROLLED ACCESS TO PRESSURIZED FLUID LINES AND TO EXHAUSTED LINES

TECHNICAL FIELD

The present invention relates to the field of access to fluid and exhausted lines; more specifically, it relates to an apparatus and a method for sampling, venting and purging blocked and unblocked pressurized fluid and blocked and unblocked exhausted lines.

BACKGROUND

Exhausted lines can become blocked by particulate or condensation products generated from the system being exhausted and blocked exhaust lines can pressurize. Pressurized fluid lines can become blocked by contaminants in the fluid. Access ports are provided in these lines for determining the location of the blockage as well as for sampling, venting and purging the lines. However, the access ports themselves can become blocked by the same materials that block the exhaust and pressurized lines. Current maintenance equipment and methods do not address these issues. Accordingly, there exists a need in the art to mitigate the deficiencies and limitations described hereinabove.

BRIEF SUMMARY

A first aspect of the present invention is an apparatus, comprising: a rod body having a longitudinal bore; a packing fitting attached to a first end of the rod body and a ball valve attached to an opposite second end of the rod body; a transverse arm between the first and second ends of the rod body, the transverse arm having a longitudinal bore communicating with the longitudinal bore of the rod body; and a slideable rod in the longitudinal bore of the rod body, the rod having a first end and an opposite second end, in a first position of the rod the first end extends through the packing fitting to outside of the rod body and the second end is completely within the rod body, in a second position of the rod the first end extends through the packing fitting to outside of the rod body and the second end of the rod extends through and past the ball valve.

A second aspect of the present invention is a method comprising: providing a ball valve, attaching a first port of the ball valve to an access port of an exhaust line or a pressurized fluid line and closing the ball valve; providing an access device comprising: a rod body having a longitudinal bore; a packing fitting attached to a first end of the rod body and a ball valve attached to an opposite second end of the rod body; a transverse arm between the first and second ends of the rod body, the transverse arm having a longitudinal bore communicating with the longitudinal bore of the rod body; and a slideable rod in the longitudinal bore of the rod body, the rod having a first end and an opposite second end, in a first position of the rod the first end extends through the packing fitting to outside of the rod body and the second end is completely within the rod body, in a second position of the rod the first end extends through the packing fitting to outside of the rod body and the second end of the rod extends through and past the ball valve; sliding the rod to the first position and connecting the second end of the rod body to a second port of the ball valve; attaching the transverse arm to a maintenance vent line; and opening the ball valve and sliding the to the second position.

A third aspect of the present invention is an apparatus, comprising: a venting and purging system comprising: a manifold having an isolation valve, a pressure gauge, a purge gas valve and a helium valve; and a purge gas tank connected to the purge valve and a helium tank connected to the helium valve; an access device comprising: a rod body having a longitudinal bore; a packing fitting attached to a first end of the rod body and a ball valve attached to an opposite second end of the rod body; a transverse arm between the first and second ends of the rod body, the transverse arm having a longitudinal bore communicating with the longitudinal bore of the rod body, the traverse arm connected to the manifold; an additional transverse arm between the first and second ends of the rod body, the additional transverse arm having an additional longitudinal bore communicating with the longitudinal bore of the rod body; and a slideable rod in the longitudinal bore of the rod body, the rod having a first end and an opposite second end, in a first position of the rod the first end extends through the packing fitting to outside of the rod body and the second end is completely within the rod body, in a second position of the rod the first end extends through the packing fitting to outside of the rod body and the second end of the rod extends through and past the ball valve.

A fourth aspect of the present invention is a method comprising: providing a venting and purging system comprising: a manifold having an isolation valve, a pressure gauge, a purge gas valve and a helium valve; and a purge gas tank connected to the purge valve and a helium tank connected to the helium valve; providing an access device comprising: a rod body having a longitudinal bore; a packing fitting attached to a first end of the rod body and a ball valve attached to an opposite second end of the rod body; a transverse arm between the first and second ends of the rod body, the transverse arm having a longitudinal bore communicating with the longitudinal bore of the rod body; an additional transverse arm between the first and second ends of the rod body, the additional transverse arm having an additional longitudinal bore communicating with the longitudinal bore of the rod body; and a slideable rod in the longitudinal bore of the rod body, the rod having a first end and an opposite second end, in a first position of the rod the first end extends through the packing fitting to outside of the rod body and the second end is contained within the rod body, in a second position of the rod the first end extends through the packing fitting to outside of the rod body and the second end of the rod extends through and past a ball valve when the ball valve is connected to the second end of the rod body; sliding the rod to the first position and connecting the second end of the rod body to the ball valve, the ball valve previously connected to an exhaust line; connecting the traverse arm of the access device to the isolation valve; connecting the additional traverse arm to a vent valve connected to a maintenance exhaust line; opening the ball valve and sliding the rod to the second position; venting the exhaust line by opening and then closing the vent valve; and purging the system by opening and then closing the purge valve.

These and other aspects of the invention are described below.

BRIEF DESCRIPTION OF THE DRAWINGS

The features of the invention are set forth in the appended claims. The invention itself, however, will be best understood by reference to the following detailed description of illustrative embodiments when read in conjunction with the accompanying drawings, wherein:

DETAILED DESCRIPTION

The access device according to the embodiments of the present invention is designed to be connected to an access port on an exhausted line or a pressurized line. The access device includes a valve designed to attach to the access port. The access device features a captured and slideable rod having a first position that does not extend past the valve allowing the valve to be closed and a second position that extends past the valve into the pressurized line or exhausted line when the access valve is open.

The embodiments of the present invention will be described in the context of accessing exhaust lines, but are equally applicable to pressurized fluid lines.

Figure 1:
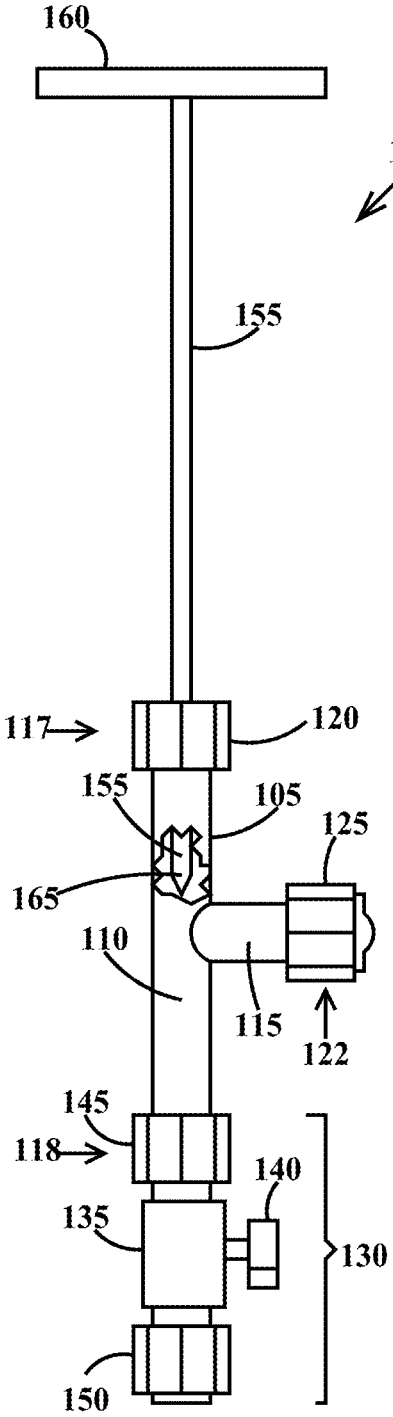
FIG. 1 is a schematic illustration of an access device in an un-mounted and closed position according to an embodiment of the present invention.

FIG. 1 is a schematic illustration of an access device in an un-mounted and closed position according to an embodiment of the present invention. In FIG. 1 an access device 100 includes a T-shaped body 105 having a tubular rod body 110 and an intersecting tubular transverse arm 115 between opposite first and second ends 117 and 118 of rod body 110. First end 117 of rod body 110 is configured to accept a packing fitting 120. Second end 118 of rod body 110 and an end 122 of transverse arm 115 are each configured to accept compression fittings (see FIGS. 6 and 7). A removable safety cap 125 is fitted to end 122 of transverse arm 115. Depending on configuration, access device 100 may include a ball valve 130 or ball valve 130 may be fixedly attached to an access port of the exhaust line (see FIG. 10) and rod body 110 attached thereto prior to use. Ball valve 130 comprises a valve body 135 and a valve knob 140 for opening and closing the ball valve. Ball valve 130 includes a first compression fitting 145 that connects ball valve 130 to end 118 of rod body 110 and a second compression fitting that is used to connect valve 130 to an exhaust line. A solid (optionally hollow) rod 155 is slideably disposed in the bore (see FIG. 6) of rod body 110. Rod 155 has a handle 160. While handle 160 is illustrated as a rod perpendicular to rod 155, it may take the shape of a knob, or simply a knurled region of rod 155. Rod 155 has a tip 165. This tip may be flat or pointed as illustrated in FIG. 1. Alternatively, tip 165 may be wedge shape, include a set of teeth, etc. In FIG. 1, ball valve 130 is closed and rod 155 is in a first position where tip 165 is retracted into rod body 110 past transverse arm 115 into rod body 110. Tip 165 must be retractable past ball valve 130 in order to close the ball valve. It is advantageous for tip 165 to be retractable past transverse arm 115 as shown in FIG. 1 in order that any blockages in the lower region of rod body 110 may be cleared and to avoid rod 155 from restricting flow between ball valve 130 and transverse arm 110. In one example, access device is constructed of stainless steel except for packing glands around rod 155 (see FIG. 6) and valve stem seals which may be formed from polymers.

Figure 2:
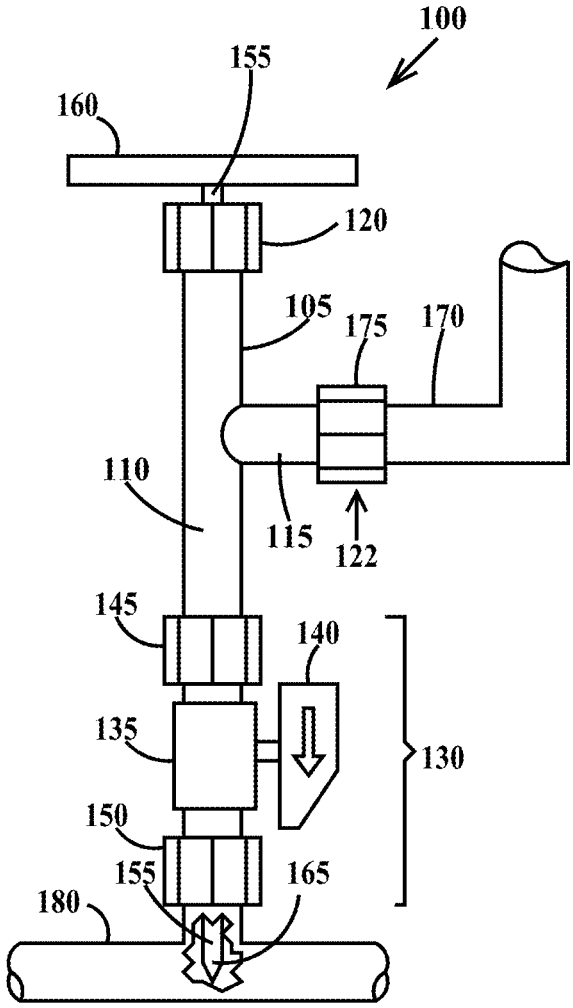
FIG. 2 is a schematic illustration of the access device of FIG. 1 connected between an exhaust line and a maintenance vent line according to an embodiment of the present invention.

FIG. 2 is a schematic illustration of the access device of FIG. 1 connected between an exhaust line and a maintenance vent line according to an embodiment of the present invention. FIG. 2 is similar to FIG. 1, except access device 100 is illustrated attached to a maintenance vent line 170 by a compression fitting 175 and attached to an exhaust line 180 to be vented and optionally purged by compression fitting 150. In the present example, maintenance vent line 170 is an exhaust line. In FIG. 2, ball valve 130 is open and rod 155 is in a second position where tip 165 is extended past ball valve 130 into exhaust line 180.

Referring to FIGS. 1 and 2, compression fitting 150 provides a hermetic seal to exhaust line 180 when ball valve 140 is closed. Compression fittings, 145 and 150, safety cap 125, and packing fitting 120 provide a hermetic seal to exhaust line 180 when ball valve 140 is open and the safety cap is in place. Packing fitting 120 provides a hermetic seal between rod body 110 and rod 155, but still allows rod body to slide. The length of rod 155 is determined by the combined length of rod body 110 so rod 155 can be fully retracted into rod body 110 to allow valve 130 to be closed, the distance rod 155 must travel through the open valve 130 and the distance rod 155 must penetrate into exhaust line 180. Again, it is advantageous, but not required that transverse arm 115 is positioned on rod body 110 so when rod 155 is retracted into rod body 110, tip 165 is above transverse arm 115 (i.e., tip 165 is between first end 117 and transverse arm 115).

Referring to FIGS. 1 and 2, an exemplary method of use of access device 100 is as follows: (1) Using compression fitting 150, ball valve 130 is pre-attached to an exhaust line (e.g., exhaust line 180), ball valve 130 closed and a safety cap (similar to safety cap 125 of FIG. 1) fitted to compression fitting 145. Some safety caps are one piece units, so they replace the nut of compression fitting 145. (2) When the exhaust line needs to be vented, purged or sampled, the safety cap is removed and rod body 110 attached in its place with rod 155 retracted at least far enough so point 165 does stop ball valve 130 from being closed. Ball valve 130 is closed at this point. (3) Compression cap 125 is removed and a maintenance vent line (e.g., maintenance vent line 170) fitted with a compression fitting (e.g., compression fitting 175) is attached to transverse arm 115. (4) Ball valve 130 is opened. (5) To ensure that the exhaust line adjacent to ball valve 130 is not plugged or ball valve 130 has not become plugged or the region of rod body between valve 130 and transverse arm 115 has not become plugged, rod 155 is fully inserted into rod body 110, through ball valve 130 until point 165 extends into the exhaust line and then retracted. This action is repeated until the plug is broken up. In the case of exhausted lines, the ball valve can become plugged as the maintenance exhaust is likely to carry along particles of the original blockage when ball valve 130 is opened. In the case of pressured fluid lines, contaminants in the fluid can cause the plug, the fluid can solidify if the temperature is near the freezing point of the fluid (e.g., water) or there is a sudden drop in pressure and solid condensate is formed. (6) One or more of venting, purging and sampling procedures is performed. Insertion and withdrawal of rod 155 may be performed during the venting, purging and sampling procedures. (7) When the venting, purging and sampling procedures are complete, rod 155 is retracted at least past ball valve 130, ball valve 130 closed, rod body 110 removed from ball valve 130 and the safety plug reattached to the ball valve.

Figure 3:
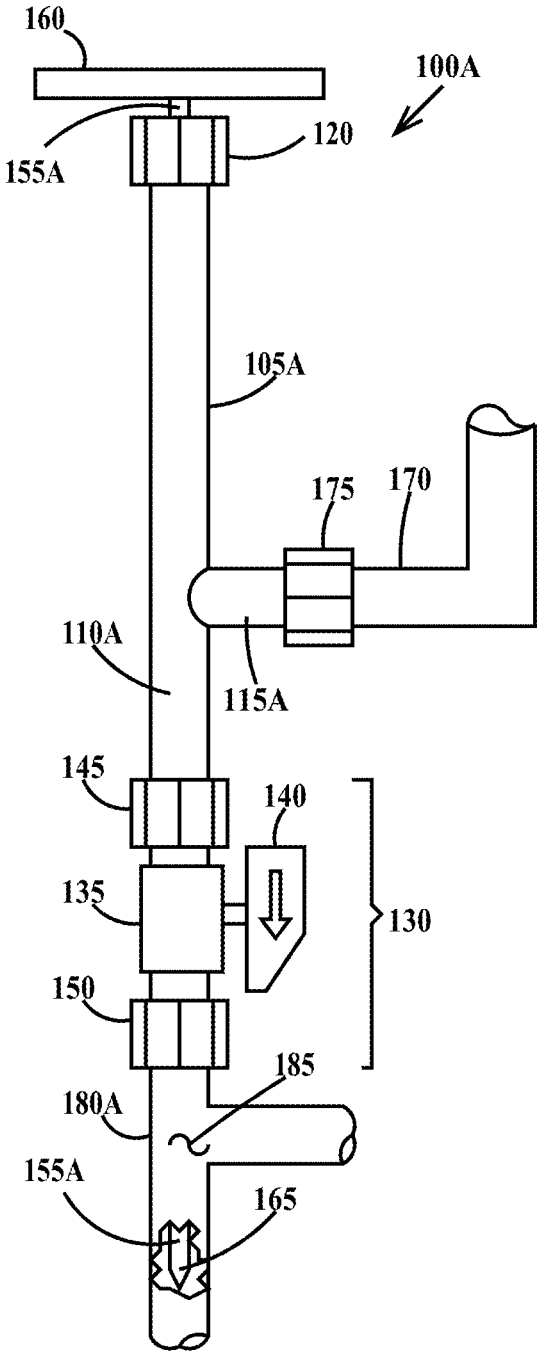
FIG. 3 is a schematic illustration of an access device similar to the access device of FIG. 2 connected between an alternative configuration of the exhaust line and the maintenance vent line according to an embodiment of the present invention.

FIG. 3 is a schematic illustration of an access device similar to the access device of FIG. 2 connected between an alternative configuration of the exhaust line and the maintenance vent line according to an embodiment of the present invention. In FIG. 3, an access device 100A is similar to access device 100 of FIG. 2 except exhaust line 180 is replaced with exhaust line 180A, rod body 110 is replaced with a longer rod body 110A and rod 155A so rod 155A can be pushed past the bend 185 in exhaust line 180A. Rod body 110A is longer than rod body 110 of FIG. 2, to accommodate the longer length of rod 155A. Transverse arm 115 of FIG. 1 has been labeled 115A in FIG. 3 but is different only in it attached to rod body 110A.

Figure 4:
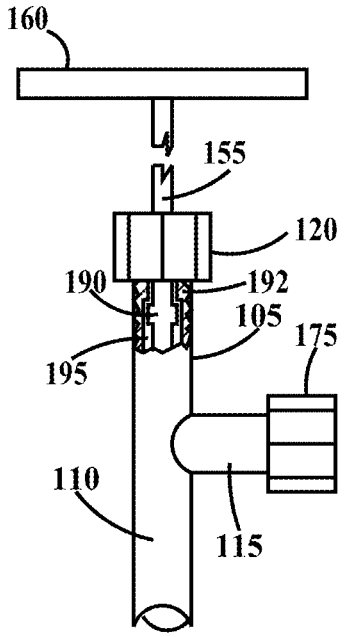
FIG. 4 is a schematic illustration of a first rod retention feature according to an embodiment of the present invention.

FIG. 4 is a schematic illustration of a first rod retention feature according to an embodiment of the present invention. In FIG. 4, rod 155 is fitted with a collar 190 that is larger in diameter than a reduced diameter bore region 192 of a longitudinal bore 195 of rod body 110. Collar 190 prevents rod 155 being pulled or pushed past or blown out of packing fitting 120.

Figure 5:
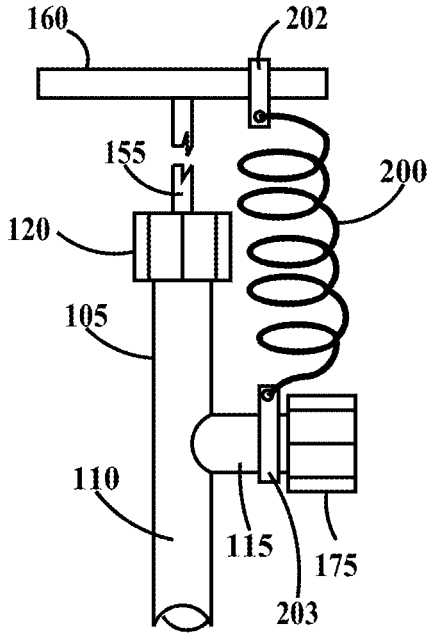
FIG. 5 is a schematic illustration of a second rod retention feature according to an embodiment of the present invention.

FIG. 5 is a schematic illustration of a second rod retention feature according to an embodiment of the present invention. In FIG. 5, a flexible steel wire 200 is connected between a band 202 attached to handle 160 and a band 203 attached to transverse arm 115. Wire 200 prevents rod 155 being pulled or pushed past or blown out of packing fitting 120.

Figure 6:
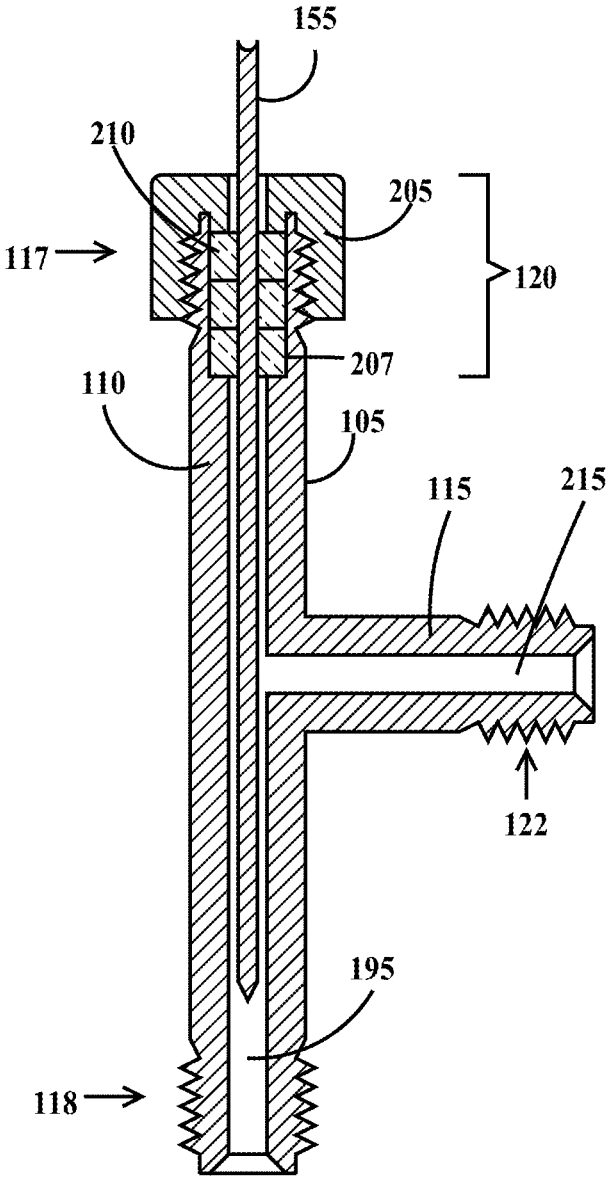
FIG. 6 is a cross-section of the rod body of the access device of FIG. 1.

FIG. 6 is a cross-section of the rod body of the access device of FIG. 1. In FIG. 6, end 117 of rod body 110 is threaded to accept a packing nut 205. An upper region 207 of bore 195 is configured to accept packing glands 210 of packing fitting 120. In one example, packing glands are a compressible fluoro-polymer. End 118 of rod body 110 is threaded and the end of bore 195 tapered to accept a compression fitting (see FIG. 7). Transverse arm 115 includes a longitudinal bore 215 communicating with longitudinal bore 195 of rod body 110. End 122 of transverse arm 115 is threaded and the end of bore 215 tapered to accept a compression fitting (see FIG. 7).

Figure 7:
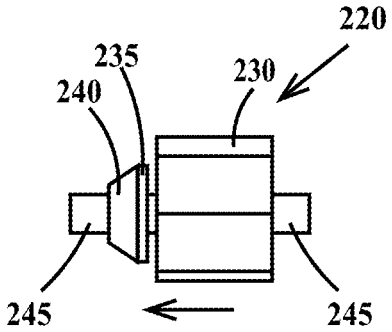
FIG. 7 is a schematic illustration of an exemplary compression fitting.

FIG. 7 is a schematic illustration of an exemplary compression fitting. In 220 a compression fitting 220 includes an internally threaded compression nut 230, a back ferrule 240 and a front ferrule 245. Compression fitting 220 is illustrated in position over a tube 245. There are many types of compression fittings known and body 105 (see FIG. 6) may be configured to accept other types of compression fittings than the one illustrated.

Figure 8:
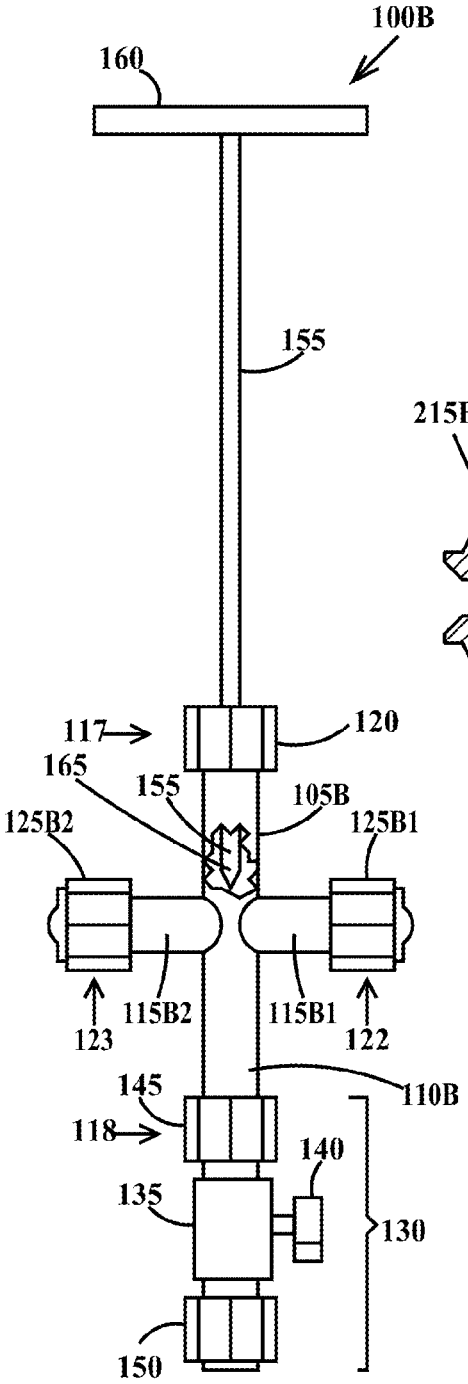
FIG. 8 is a schematic illustration of an alternative access device in an un-mounted and closed position according to an embodiment of the present invention.

FIG. 8 is a schematic illustration of an alternative access device in an un-mounted and closed position according to an embodiment of the present invention. FIG. 8 differs from FIG. 1 only in that an access device 110B includes two transverse arms 115B1 and 115B2 instead of the single transverse arm 115 of access device 100 of FIG. 1. In FIG. 8, a rod body 105B includes a first transverse arm 115B1 and a second transverse arm 115B2. An end 122 of transverse arm 115B1 and an end 123 of traverse arm 115B2 are each configured to accept compression fittings (see FIGS. 6 and 9). A removable safety cap 125B1 is fitted to end 122 of transverse arm 115B1 and a removable safety cap 125B2 is fitted to end 123 of transverse arm 115B2.

Figure 9:
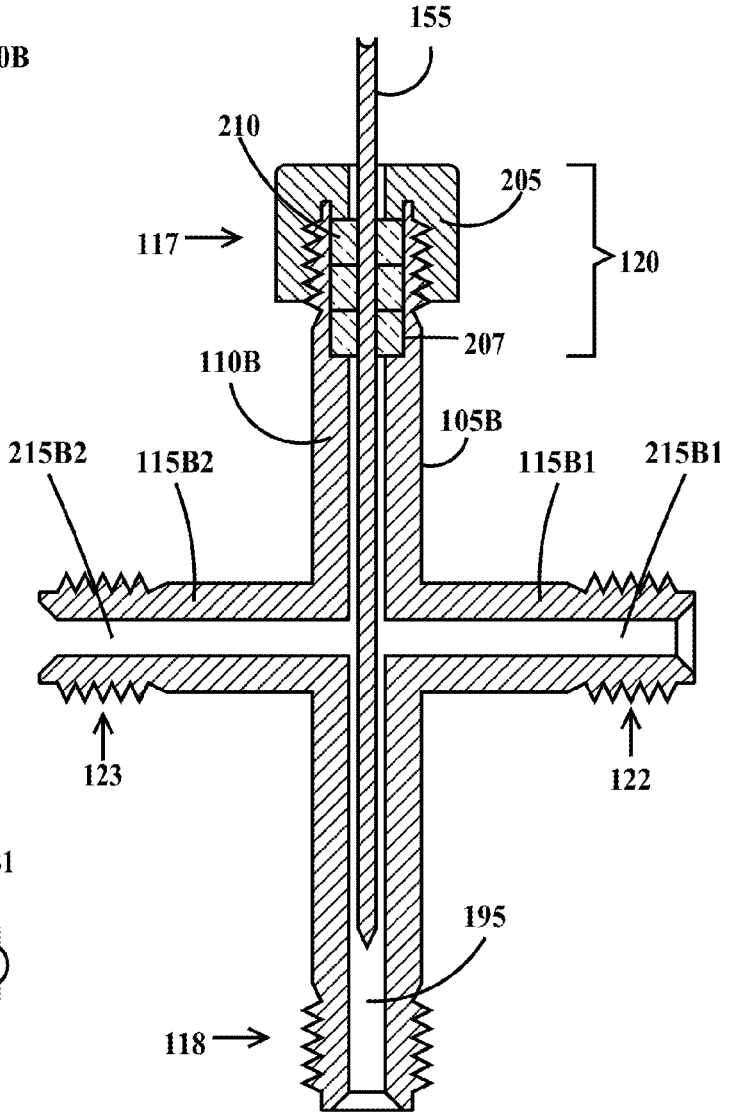
FIG. 9 is a cross-section of the rod body of the access device of FIG. 8.

FIG. 9 is a cross-section of the rod body of the access device of FIG. 8. In FIG. 9, end 117 of rod body 110B is threaded to accept packing nut 205. An upper region 207 of bore 195 is configured to accept packing glands 210 of packing fitting 120. End 118 of rod body 110B is threaded and the end of bore 195 tapered to accept a compression fitting (see FIG. 7). Transverse arm 115B1 includes a longitudinal bore 215B1 communicating with longitudinal bore 195 of rod body 110B. End 122 of transverse arm 115B1 is threaded and the end of bore 215B1 tapered to accept a compression fitting (see FIG. 7). Transverse arm 115B2 includes a longitudinal bore 215B2 also communicating with longitudinal bore 195 of rod body 110B. End 123 of transverse arm 115B2 is threaded and the end of bore 215B2 tapered to accept a compression fitting (see FIG. 7). While transverse arms 115B1 and 115B2 are illustrated as coaxially aligned, the transverse arms may be (i) offset in the plane of the paper, (ii) offset so they are perpendicular to one another or (iii) both offset in the plane of the paper and offset so they are perpendicular to one another.

Figure 10:
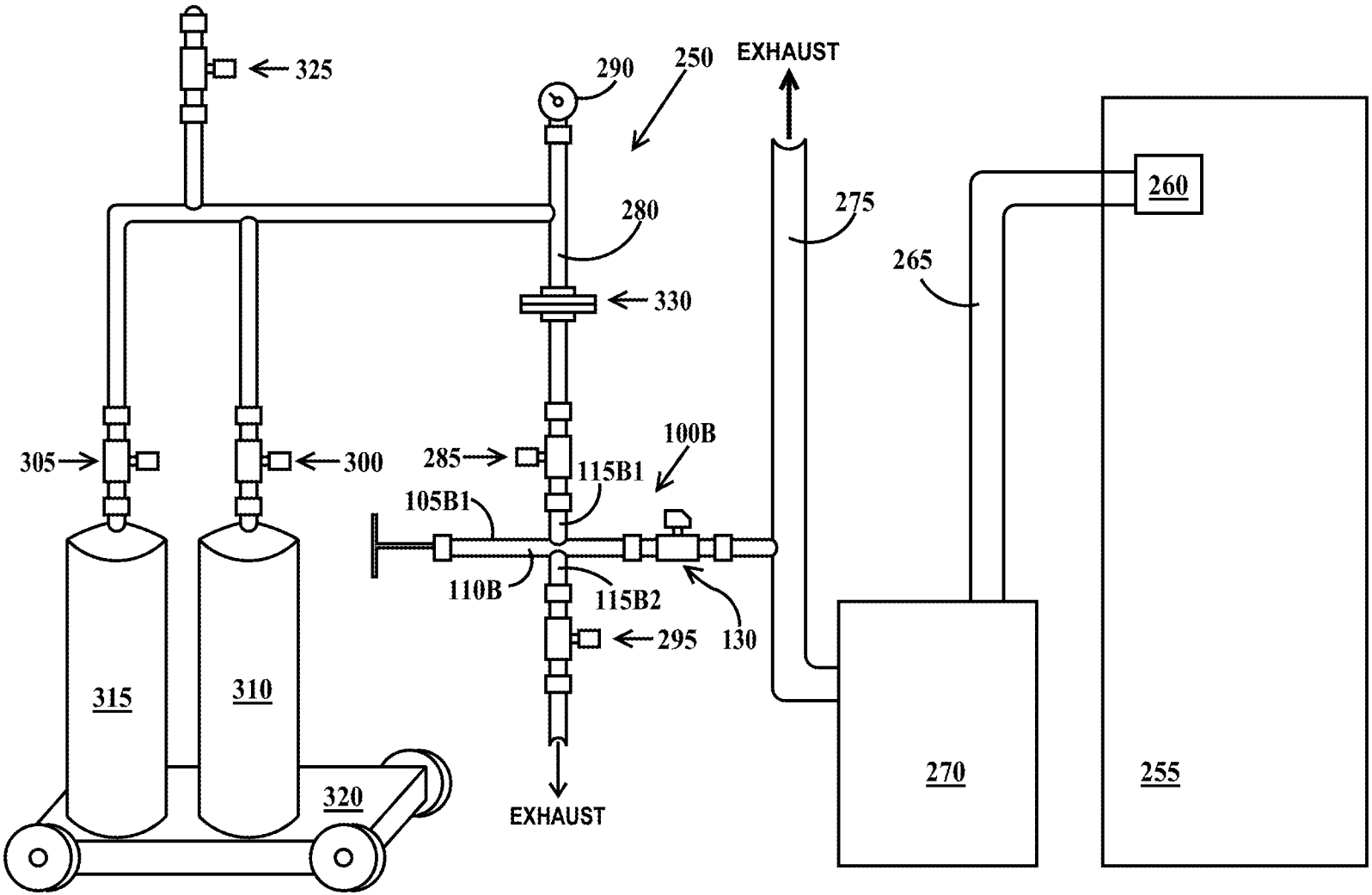
FIG. 10 is a schematic illustration of the access device of FIG. 1 attached to an exemplary exhausted system.

FIG. 10 is a schematic illustration of the access device of FIG. 1 attached to an exemplary exhausted system. Certain process tools can experience premature and unexpected pumping failures due to solid effluent by-products of the process building up in forelines, pumps and exhaust lines resulting in trapped toxic gases. In FIG. 10, a venting and purging system 250 (which includes pressure checking and can be adapted for sampling has been connected to the vacuum system of a semiconductor manufacturing tool 255. Manufacturing tool 255 includes a gate valve 260. Gate valve 260 is connected to a foreline 265 which in turn is connected to a vacuum pump 270. Vacuum pump 270 is connected to facilities exhaust line 275 which in turn is connected to a fan or a tool specific scrubber. Venting and purging system 250 includes access device 100B, manifold 280, isolation valve 285, pressure gauge 290, purge gas valve 300, helium valve 305, purge gas tank 310, helium tank 315 and an optional cart 320, an optional sampling valve 325 and a filter 330. In the present example, ball valve 130 of access device 100B is pre-attached to exhaust line 275 and remains in place (in the closed position) and capped when venting and purging system 250 is disconnected from exhaust line 275. This allows venting and purging system 250 to be used with multiple manufacturing tools that are each equipped with a ball valve 130. Access device 100B is connected to exhaust line 275 by ball valve 130. Access device 100B is connected to a first port of filter 330 by an isolation valve 285 connected to transverse arm 115B1. A second port of filter 330 is connected to manifold 280. This arrangement prevents contaminants from manufacturing tool 260, foreline 265, vacuum pump 270 and exhaust line 275 from entering manifold 280. Access device 100B is connected to a maintenance exhaust by a vent valve 295 connected to transverse arm 115B2. Purge gas valve 300 is connected to a tank 310 of a purge gas (e.g., nitrogen) and helium valve 305 is connected to a helium tank 315. Tanks 310 and 315 are optionally mounted to cart 320. Helium gas is used for helium leak detecting. The purge gas is used to purge manifold 280. Rod 155 (see FIG. 2) is used to unplug ball valve 130 and the lower portion of rod body 110 in the event they get plugged during pressure checking, venting, purging or sampling procedures.

An exemplary venting and purging procedure comprises: (1) In an initial position ball valve 130, isolation valve 285, vent valve 295, purge valve 300, helium valve 305 and sampling valve 325 are closed. Sampling valve 325 may also be safety capped. (2) Isolation valve 285, vent valve 295, and purge valve 300 are opened to purge system 250. Isolation valve 285 and purge valve 300 are then closed to allow safe venting of exhaust line 275 through ball valve 130. (3) Ball valve 130 is opened to relieve pressure in exhaust line 275. Rod 155 is inserted into and retracted from ball valve 130 and exhaust line 275 several times to assure no blockages remain between exhaust line 275 and exhaust valve 295. (4) Exhaust valve 295 is closed and isolation valve 285 is then opened to check for pressure in exhaust line 275. (5) Exhaust line 275 can now be leak checked using helium valve 305. (6) Ball valve 130, isolation valve 285, purge valve 300, helium valve 305 are closed. (7) Vent valve 295 can now be closed. (8) When venting and purging system 250 is disconnected from ball valve 130, ball valve 130 is safety capped.

Examples of semiconductor process tools to which the present invention is applicable includes, but is not limited to chemical vapor deposition (CVD) tools, low pressure CVD (LPCVD) tools, reactive ion etch (RIE) tools and plasma etch and deposition tools. Examples of toxic gases used in these tools include ammonia, chlorine, fluorine, silane, diborane, arsine, metal fluorides, organo metallic compounds, organic fluoro-organic compounds and chloro-organic compounds.

Figure 11:
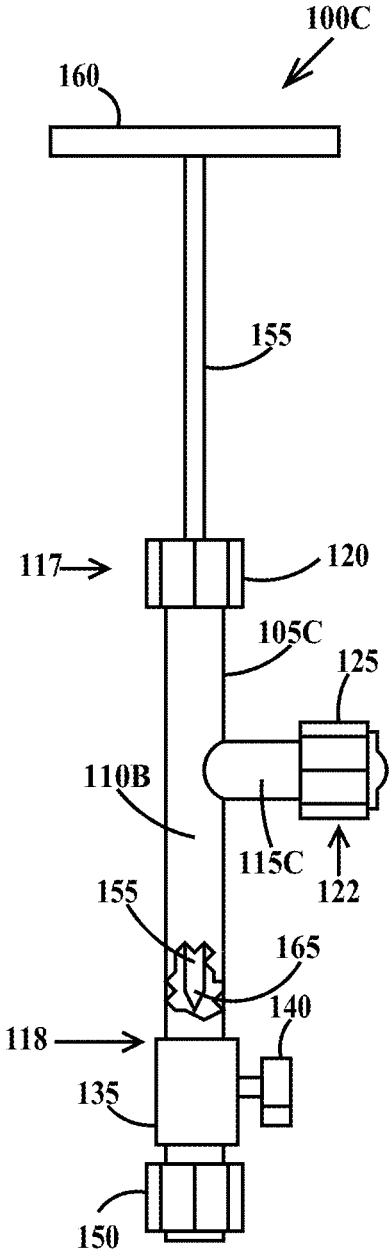
FIG. 11 is a schematic illustration of modified configuration of the access device of FIG. 1 according to an embodiment of the present invention.

FIG. 11 is a schematic illustration of modified configuration of the access device of FIG. 1 according to an embodiment of the present invention. In FIG. 11, an access device 110B is similar to access device 100 of FIG. 1, except ball valve body 135 is integral to or permanently attached (e.g., welded) to end 118 of a rod body 110C.

Figure 12:
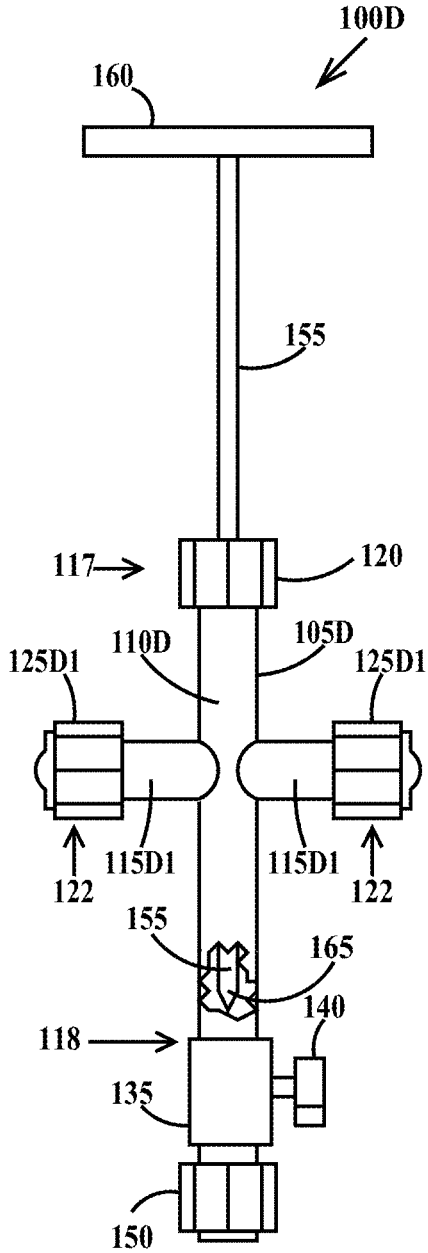
FIG. 12 is a schematic illustration of modified configuration of the access device of FIG. 8 according to an embodiment of the present invention

FIG. 12 is a schematic illustration of modified configuration of the access device of FIG. 8 according to an embodiment of the present invention. In FIG. 12, an access device 110D is similar to access device 100B of FIG. 8, except ball valve body 135 is integral to or permanently attached (e.g., welded) to end 118 of a rod body 110D.

Thus the embodiments of the present invention provide an apparatus and a safe method for sampling, venting and purging blocked and unblocked pressurized fluid and blocked and unblocked exhausted lines.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. An apparatus, comprising:

a venting and purging system comprising:

a manifold having an isolation valve, a pressure gauge, a purge gas valve and a helium valve; and a purge gas tank connected to said purge valve and a helium tank connected to said helium valve;

an access device comprising:

a rod body having a longitudinal bore;

a packing fitting attached to a first end of said rod body and a valve attached to an opposite second end of said rod body;

a transverse arm between said first and second ends of said rod body, said transverse arm having a longitudinal bore communicating with said longitudinal bore of said rod body, said traverse arm connected to said manifold;

an additional transverse arm between said first and second ends of said rod body, said additional transverse arm having an additional longitudinal bore communicating with said longitudinal bore of said rod body; and a slideable rod in said longitudinal bore of said rod body, said rod having a first end and an opposite second end, in a first position of said rod said first end extends through said packing fitting to outside of said rod body and said second end is completely within said rod body, in a second position of said rod said first end extends through said packing fitting to outside of said rod body and said second end of said rod extends through and past said valve.

2. The apparatus of claim 1, wherein in said first position of said rod said second end of said rod is within said rod body between said transverse arm and said packing fitting.

3. The apparatus of claim 1, further including a handle attached to said first end of said rod.

4. The apparatus of claim 1, further including means to prevent said second end of said rod from being completely withdrawn from said longitudinal bore of said rod body through said packing fitting.

5. The apparatus of claim 1, wherein said means to prevent said second end of said rod being completely withdrawn from said longitudinal bore of said rod body through said packing fitting comprises (i) a flexible wire, a first end of said flexible wire connected between a handle attached to said first end of said rod and a second end of said flexible wire connected to transverse arm or (ii) comprises a collar on said rod, a diameter of said collar greater than diameter than a diameter of said rod and greater than a diameter of said longitudinal bore in a reduced bore region of said longitudinal bore of said rod body.

6. The apparatus of claim 1, wherein said rod body is a single integral unit.

7. The apparatus of claim 1, wherein said valve is a ball valve.

8. A method comprising:

providing a venting and purging system comprising:

a manifold having an isolation valve, a pressure gauge, a purge gas valve and a helium valve; and a purge gas tank connected to said purge valve and a helium tank connected to said helium valve;

providing an access device comprising:

a rod body having a longitudinal bore;

a packing fitting attached to a first end of said rod body and a valve attached to an opposite second end of said rod body;

a transverse arm between said first and second ends of said rod body, said transverse arm having a longitudinal bore communicating with said longitudinal bore of said rod body;

an additional transverse arm between said first and second ends of said rod body, said additional transverse arm having an additional longitudinal bore communicating with said longitudinal bore of said rod body; and a slideable rod in said longitudinal bore of said rod body, said rod having a first end and an opposite second end, in a first position of said rod said first end extends through said packing fitting to outside of said rod body and said second end is contained within said rod body, in a second position of said rod said first end extends through said packing fitting to outside of said rod body and said second end of said rod extends through and past said valve when said valve is connected to said second end of said rod body;

sliding said rod to said first position and connecting said second end of said rod body to said valve, said ball valve previously connected to an exhaust line;

connecting said traverse arm of said access device to said isolation valve;

connecting said additional traverse arm to a vent valve connected to a maintenance exhaust line;

opening said valve and sliding said rod to said second position;

venting said exhaust line by opening and then closing said vent valve; and purging said system by opening and then closing said purge valve.

9. The method of claim 8, further including:

during said venting sliding said rod between said first position and said second position multiple times.

10. The method of claim 8, further including:

sliding said rod to said first position, closing said valve and removing said access device from said valve.

11. The method of claim 8, wherein said access device, includes means to prevent said second end of said rod from being completely withdrawn from said longitudinal bore of said rod body through said packing fitting.

12. The method of claim 8, wherein said exhaust line is connected to a vacuum pump, said vacuum pump connected to a foreline and said foreline connected to a semiconductor manufacturing tool.

13. The method of claim 8, wherein said valve is a ball valve.

* * * * *